US010492970B2

(12) United States Patent
Merino et al.

(10) Patent No.: US 10,492,970 B2
(45) Date of Patent: Dec. 3, 2019

(54) MOBILE ISOLATION AND CONTAINMENT UNIT

(71) Applicant: AMoHS, Inc., Boulder, CO (US)

(72) Inventors: Michael T. Merino, Louisville, CO (US); William C. Waugh, Corona, CA (US); Anton E. Hosch, Jr., Golden, CO (US)

(73) Assignee: AMOHS, INC., Boulder, CO (US)

( * ) Notice: Subject to any disclaimer, the term of this patent is extended or adjusted under 35 U.S.C. 154(b) by 739 days.

(21) Appl. No.: 14/934,861

(22) Filed: Nov. 6, 2015

(65) Prior Publication Data

US 2016/0128886 A1 May 12, 2016

Related U.S. Application Data

(60) Provisional application No. 62/076,801, filed on Nov. 7, 2014.

(51) Int. Cl.
*A61G 10/00* (2006.01)
*A61G 10/02* (2006.01)
(Continued)

(52) U.S. Cl.
CPC ..... *A61G 10/005* (2013.01); *A61G 9/00* (2013.01); *A61G 10/02* (2013.01); *E04H 1/1277* (2013.01); *E04H 3/08* (2013.01); *F24F 11/74* (2018.01)

(58) Field of Classification Search
CPC ..... A61G 10/00; A61G 10/02; A61G 10/005; A61G 10/023
See application file for complete search history.

(56) References Cited

U.S. PATENT DOCUMENTS 5,236,390 A 8/1993 Young
5,551,102 A 9/1996 Stewart et al.
(Continued)

FOREIGN PATENT DOCUMENTS

JP 2011041765 A 3/2011
WO 2005040528 A1 5/2005
(Continued)

OTHER PUBLICATIONS http://emorymedicinemagazine.emory.edu/issues/2014/fall/features/special-isolation-unit/index.html (Last viewed Oct. 29, 2015).
(Continued)

*Primary Examiner* — Carrie R Dorna
(74) *Attorney, Agent, or Firm* — Downs Rachlin Martin PLLC

(57) ABSTRACT

Completely self-contained and self-supported mobile isolation and containment unit (ICU) facilities are disclosed that can be transported on roads and highways to a location in need of an isolation facility and rapidly deployed to provide isolation and treatment. In some embodiments, exemplary ICUs can safely provide isolation and treatment to a level that meets or exceeds "bricks and mortar" hospital isolation and containment facilities and any applicable regulations. In some examples, the mobile ICUs include sophisticated heating ventilation and air Conditioning (HVAC) systems that can separately maintain areas within the facility at different levels of pressure to ensure contaminated air does not escape the facility. And the mobile ICUs may also incorporate a multiple-vestibule with airlock design for ensuring safe entry and exit from the facility. The mobile ICUs disclosed herein may also include automated decontamination systems for disinfecting and/or sterilizing spaces within the facility.

20 Claims, 8 Drawing Sheets

(51) Int. Cl.

| | |
|---|---|
| ***E04H 1/12*** | (2006.01) |
| ***A61G 9/00*** | (2006.01) |
| ***E04H 3/08*** | (2006.01) |
| *F24F 11/74* | (2018.01) |

(56) References Cited

U.S. PATENT DOCUMENTS

| | | | | |
|---|---|---|---|---|
| 7,985,382 | B1 | 7/2011 | Henry et al. | |
| 2006/0107635 | A1* | 5/2006 | Homan ..... | A61G 10/023 55/385.2 |
| 2013/0109291 | A1 | 5/2013 | Holtz et al. | |

FOREIGN PATENT DOCUMENTS

| | | | |
|---|---|---|---|
| WO | 2007081285 | A1 | 7/2007 |
| WO | 2007119009 | A1 | 10/2007 |
| WO | 2008104085 | A1 | 9/2008 |

OTHER PUBLICATIONS http://www.odulair.com/mobile-ebola-isolation-treatment-center-portable-ebola-lab.html (Last viewed Oct. 29, 2015).

PCT International Search Report dated Apr. 19, 2017, in corresponding International Patent Application No. PCT/US2015/059545.

* cited by examiner

MOBILE ISOLATION AND CONTAINMENT UNIT

RELATED APPLICATION DATA

This application claims the benefit of priority of U.S. Provisional Patent Application Ser. No. 62/076,801, filed Nov. 7, 2014, and titled Mobile Isolation and Containment Unit, which is incorporated by reference herein in its entirety.

FIELD OF THE INVENTION

The present disclosure generally relates to the field of mobile healthcare units. In particular, the present disclosure is directed to mobile isolation and containment units.

BACKGROUND

Isolation and containment facilities, also sometimes referred to as biocontainment facilities, are designed to provide a first line of care for patients infected by pathogenic agents and/or organisms while preventing the transfer of the pathogens to others. Some hospitals have added biocontainment facilities in recent years in preparedness for bio terrorism and/or naturally occurring diseases such as Severe Acute Respiratory Syndrome (SARS), Ebola, or the Avian Influenza. Such hospital-based facilities, however, are relatively few in number, do not provide a flexible on-location solution, and require locating infected patients as well as the associated contaminated waste and materials, within the hospital. While some mobile biocontainment units exist, their design and function typically lack important features.

SUMMARY OF THE DISCLOSURE

In one embodiment, the present disclosure is directed to a mobile isolation unit. The mobile isolation unit includes a first and a second vestibule; a common area; and at least one patient room, wherein entry to the common area from a location outside the mobile isolation unit or exit from the common area to a location outside the mobile isolation unit requires passage through both of the first and second vestibules, wherein one of the first and second vestibules is adjacent the common area and is configured as an airlock to prevent the flow of contaminated air from the mobile isolation unit.

In another embodiment, the present disclosure is directed to a method of controlling the entering to and/or exiting from a mobile isolation unit having at least two vestibules, a common area, and a heating, ventilation, and air-conditioning (HVAC) system, a first one of the at least two vestibules being located adjacent the common area and having a first door and a second door. The method includes securing the first and second doors; instructing the HVAC system to pressurize the first one of the at least two vestibules to a pressure that exceeds a pressure in the common area by a first amount; monitoring the pressure in the first one of the at least two vestibules and the common area; and unlocking only one of the first and second doors when the pressure in the first one of the at least two vestibules exceeds the pressure in the common area by the first amount.

In yet another embodiment, the present disclosure is directed to a method of removing decontaminated waste from a mobile isolation unit having a common area, a soiled workroom, and a contaminated waste room, a first door separating the common area from the soiled workroom, a second door separating the soiled workroom from the contaminated waste room, and a third door separating the contaminated waste room from the outside environment. The method includes sealing contaminated waste in a first bag at a location within the mobile isolation unit where the contaminated waste is generated; transporting the first bag with the contaminated waste to the soiled workroom; in the soiled workroom, sealing the first bag with the contaminated waste in a second bag but not storing the contaminated waste in the soiled workroom; transporting the second bag with the first bag and contaminated waste to the contaminated waste room; and storing the second bag with the first bag and contaminated waste in the contaminated waste room.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

Embodiments of the present disclosure include completely self-contained and self-supported mobile isolation and containment unit (ICU) facilities that can be transported on roads and highways to a location in need of an isolation facility and rapidly deployed to begin providing isolation and treatment. As described more below, in some embodiments, exemplary ICUs disclosed herein can safely provide isolation and treatment to a level that meets or exceeds "bricks and mortar" hospital isolation and containment facilities and any applicable regulations, including safely isolating patients with diseases that may be transferred to others by either touch or through the air. In some examples, the mobile isolation units include sophisticated heating ventilation and air conditioning (HVAC) systems that can separately maintain areas within the facility at different levels of pressure to ensure contaminated air does not escape the facility. And the mobile ICUs may also incorporate a multiple-vestibule with airlock design for ensuring safe entry and exit from the facility. Mobile ICUs made in accordance with the present disclosure may also include automated decontamination systems for disinfecting and/or sterilizing spaces within the facility.

Figure 1:
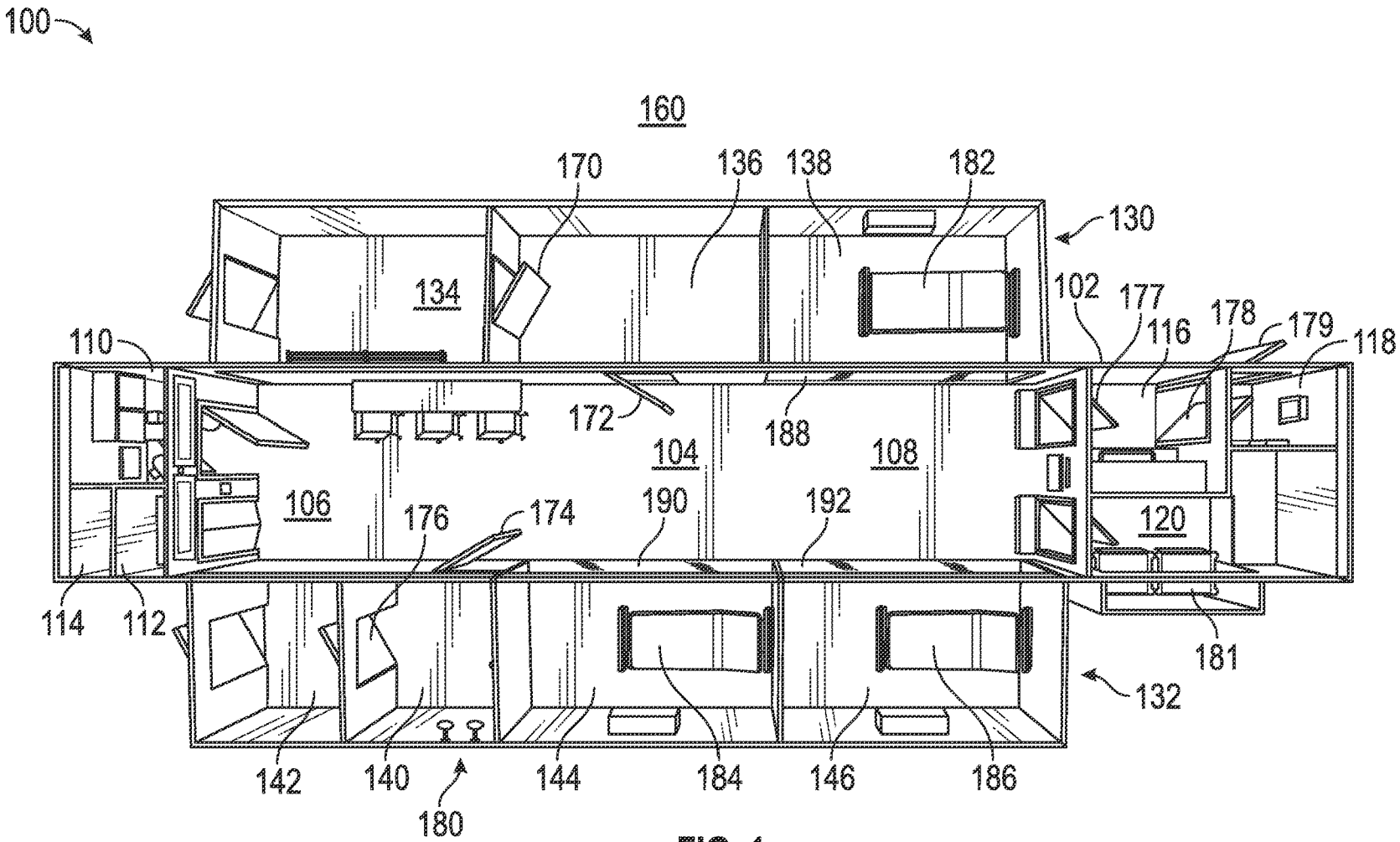
FIG. 1 is a plan view of a first embodiment of a mobile isolation and containment unit.

FIG. 1 illustrates one example of a mobile ICU 100 made in accordance with the present disclosure. In the illustrated example, ICU 100 is a self-contained unit that can be quickly deployed to provide isolation and containment functions that may not be available at local hospitals, or that may be better addressed outside of a hospital. ICU 100 may include a central section 102 having a main corridor or anteroom 104 with first and second ends 106, 108. Central section 102 may also include a restroom 110, janitor's closet 112, and medical gas storage 114 at first end 106 of corridor 104 and a soiled workroom 116, a contaminated waste room 118 (which may also serve as an emergency exit), and a clean workroom 120 at second end 108 of the corridor. ICU 100 may also include first and second side sections 130, 132. As shown, first side section 130 may include first and second entry vestibules 134 and 136 for gaining access to ICU 100 and a first patient room 138 for isolating and treating a patient. Second side section 132 may include first and second exit vestibules 140 and 142 for exiting ICU 100, and side section 132 may also include second and third patient rooms 144 and 146.

In one embodiment, ICU 100 is a wheeled trailer of the sort pulled by a separate "tractor" (not shown) on roads and highways. In other embodiments, ICU 100 may lack wheels and be transported on a flatbed truck, by helicopter or otherwise to a desired location. In this regard, ISO containers and other known structures may be used for one or more sections of ICU 100. The lengths and widths of central section 102 and side sections 130,132 may vary depending on intended application, although in one implementation the central section is about 60 feet long and 12 feet wide. In another example central section 102 may be about 53 feet long and 8.5 feet wide. The length and width of side sections 130, 132 may also be chosen in view of the intended application, although in one implementation the side sections are 30 feet long and 12 feet wide. In another implementation they may be 37 feet long and 7 feet wide. The amount of space enclosed by each of the spaces within central and side sections 102, 130, 132 may be selected to satisfy whatever regulations, standards of care, insurance requirements, Medicare requirements and other criteria are in place at the time and location where ICU 100 is used.

In one embodiment, side sections 130 and 132 may be separate sections that are bolted to or otherwise attached to central section 102 after moving the central section to a desired location. With such an embodiment, side sections 130 and 132 may be manufactured off-site and trucked or otherwise transported to the location where ICU 100 is installed, or may be built at such location. In another embodiment, side sections 130 and 132 may be mounted to central section 102 so as to slide or fold in and out relative to the central section from a position fully nested with the central section to a fully expanded position as shown in FIG. 1. In cases where side sections 130, 132 are configured to fold, slide or otherwise move from a retracted to extended position, ICU 100 may be designed such that any equipment located in the side sections must be removed or re-positioned to permit the side sections to be nested. In one embodiment, central section 102 may be designed and constructed so that it may be transported on roadways as a single unit. In another embodiment, central section 102 together with side sections 130, 132, may be designed and constructed so that they may be transported on roadways as a single unit. In yet another embodiment, each of side sections 130 and 132 may be designed and constructed so that they may be transported on roadways as a single unit.

To permit proper isolation and treatment of patients infected by infectious agents and diseases, including both airborne and non-airborne diseases, illustrated ICU 100 may be designed and constructed to satisfy governmental regulations, health insurance and Medicare reimbursement standards, healthcare industry requirements, guidelines promulgated by the Centers for Disease Control and Prevention and/or the National Institutes of Health, and other relevant requirements as relates to isolation and containment units, as the intended use of ICU 100 dictates. Such requirements may include, without limitation, minimum square footages for interior spaces of ICU 100, certain minimum air filtration, air pressure and air exchange requirements, and positively and negatively charged rooms to minimize airborne contamination (described more below). Other requirements include equipment required to ensure proper treatment of infected individuals including, e.g., endoscopes, anesthesia machines, gas supplies for such machines, electrosurgery generators, insufflators, cameras, surgical tools, video displays, a "code blue" cart, and/or any equipment required to ensure lifesaving support of a patient.

As noted above, ICU 100 may include a stand-alone heating ventilation and air conditioning (HVAC) system (not illustrated) that is designed and constructed to meet or exceed any applicable standards for isolation and containment facilities. In one example, the HVAC system may be configured to maintain all or a portion of ICU 100 at a lower pressure than a surrounding space, also referred to as maintaining a space at negative pressure, so that any air flow is from adjacent spaces and into the space, thereby ensuring contaminated air within a space does not leak into adjacent spaces or the outside. In one example, each of patient rooms 138, 144, and 146 may include separate air supply and returns and be separately controlled such that each of the patient rooms can be independently controlled at a negative pressure with respect to spaces outside of the patient rooms, including one or more of the other spaces within ICU 100, such as corridor 104, and/or the external environment 160 outside of ICU 100. Such a negative pressure design ensures that no contaminated air from one of patient rooms 138, 144, or 146 will leak into other areas of the ICU or to outside environment 160 and that when a door to one of the patient rooms (not illustrated) is opened, air flows from the corridor into the patient room. In one example, the following qualitative relative steady-state pressure ("RSSP") relationships may be maintained by the HVAC system among the spaces of ICU 100: patient rooms 138, 144, 146: −2 RSSP; corridor 104: −1 RSSP; clean workroom 120: +1 RSSP; soiled workroom 116: −2 RSSP; contaminated waste room 118: −3 RSSP; restroom 110: −2 RSSP; medical gas storage 114: −1 RSSP; janitor's closet 112: −1 RSSP; second entry vestibule 136 when pressurized prior to entry to corridor 104: at least +1 RSSP; first exit vestibule 140 when pressurized prior to entry to the vestibule from corridor 104: at least +1 RSSP.

In one example, a negative pressure condition is achieved by exhausting a larger amount of air from a space than is supplied to the space. The specific ratios of inlet to exhaust airflow and levels of airflow for maintaining a desired negative pressure may be set according to accepted design practice and applicable design regulations. In one example, a difference in airflow between supply and return in a room may be in the range of approximately 50 CFM to approximately 100 CFM. In other examples, the difference in airflow may be greater than 100 CFM. As will be appreciated by a person having ordinary skill in the art (POSIA), the degree to which any one of the spaces within ICU 100 is airtight and the operating characteristics of the HVAC system are interrelated such that levels of supply and exhaust airflow required for a desired pressure condition depend on the degree to which the room is airtight. In one example, at least patient rooms 138, 144, and 146 may be designed as relatively airtight rooms so as to prevent the recirculation of air between the patient rooms and other spaces within the ICU. In one example separate stand-alone filtering and ventilation units may be utilized for each patient room 138, 144, and 146 to provide the required airflow for achieving negative pressure. In other embodiments, an integrated system may be utilized. In yet other embodiments, a combination may be used. For example, a central air handling unit located, e.g., on the roof of the unit, may be used for providing conditioned air to each of the spaces within the unit. A backup central air handling unit may also be included. The relative pressures of each room may be controlled, in one example, by adjusting a restriction in the supply ducting to a room, e.g., a damper. In addition to or instead of controlling pressure via a damper from a central system, separate air handling units for each space may also be used for creating a specified room pressure.

In one example, to avoid cross-contamination among the various spaces within ICU 100, supply air for at least each of patient rooms 138, 144, and 146 is obtained from outside environment 160 and not recycled from other spaces within the ICU 100. The supply air for each of patient rooms 138, 144, and 146 may be filtered according to any applicable standard. In one example, supply air to each of patient rooms 138, 144, and 146 may pass through at least one HEPA filter. In some examples, the supply air may also be disinfected with one or more disinfection systems such as UV and/or incendiary systems. Similarly, exhaust air from each of patient rooms 138, 144, and 146 may be directly exhausted to outside environment 160 rather than recirculated in the HVAC system to avoid cross-contamination. The exhaust air may be filtered according to any applicable standard, e.g., filtering the air through one or more separate HEPA filters for each of patient rooms 138, 144, and 146. The exhaust air may also be decontaminated using any of a variety of decontamination systems, including UV, fogging, and/or incendiary systems. Each space's air may be separate exhausted to the outside after passing though one or more passive and active filtering and decontaminating systems, or all of the exhaust air may be collected for filtration and decontamination at a single point and then exhausted to the outside.

As used herein, the term HVAC and HVAC system refers to any component or system used for one or more of heating, ventilation, air conditioning, or otherwise controlling the indoor environment, whether the components are part of an integrated system, or are discrete elements or systems that operate independently of other HVAC systems and components. In one example, supply and return locations for each space within ICU 100 may be selected according to accepted design practices to prevent stagnation of air and short-circuiting of air between supply and exhaust locations. Further, in some examples, air curtains at the entrance and exit of one or more of the spaces within ICU 100 may be utilized to reduce airflow between spaces. In one example, each of patient rooms 138, 144, and 146 may have a door (not illustrated) that isolates the patient room from corridor 104. In one example, the patient room doors are hermetically sealed sliding doors. In some examples, air curtain systems may be incorporated with the sliding doors such that a curtain of air calibrated for the size of the opening is projected across the door opening at a sufficient velocity to minimize the exchange of air between corridor 104 and the patient rooms.

To improve patient comfort, individual patient rooms 138, 144, and 146 may include separate heating systems and/or drying systems to ensure comfortable temperature and humidity. In one example, each of patient rooms 138, 144, and 146 may include automatic decontamination systems (described more below) that may increase the moisture levels and humidity of the rooms. The individual heating and/or drying systems may be separately activated after a disinfecting or sterilization process and prior to patient entry to ensure the patient room is comfortable upon entry. In one example, the heating systems may include sealed heating elements located within patient rooms 138, 144, and 146 or on the outside walls of the patient rooms, as well as heating elements in beds 182, 184, and 186. For example, in-wall electric forced air units may be used. In one example, bed heating elements may be located in sealed waterproof containment envelopes and may also include additional replaceable waterproof envelopes to protect the integrity of the primary envelope.

In the illustrated example, ICU 100 incorporates a multiple-vestibule design that includes two entry vestibules 134, 136, and two exit vestibules 140, 142. In the illustrated example, second entry vestibule 136 and first exit vestibule 140 are designed and configured as airlocks to help ensure no contaminated air will exit the facility. For example, exemplary second entry vestibule 136 includes an entry-side door 170 and a facility-side door 172. In one example, doors 170, 172 include locking mechanisms and ICU 100 includes an airlock control system (FIG. 9) that monitors the status of the locking mechanisms and controls opening and closing the locking mechanisms. In one example, the airlock control system will not allow both of doors 170 and 172 to be opened at the same time. Instead, entry to entry vestibule 136 through door 170 can only occur when door 172 is secured. Similarly, after entering entry vestibule 136, facility-side door 172 can only be opened for entry to corridor 104 after entry-side door 170 is closed and indicated as secure by the airlock control system. Such a control procedure ensures there will not be a direct flow of contaminated air from corridor 104 to first entry vestibule 134 and outside 160.

In addition to controlling the opening and closing of doors 170, 172, the HVAC system of ICU 100 may be configured to separately control the pressure of entry vestibule 136 to either a positive or negative pressure with respect to first entry vestibule 134 and corridor 104. In one example, the airlock control system may be configured to cause the HVAC system to positively pressurize second entry vestibule 136 after someone has entered the second entry vestibule and both doors 170, 172 are indicated as closed and secured. In some examples, a separate air handling unit may be used for positively pressurizing second entry vestibule 136. The airlock control system may also include at least one pressure sensor configured to monitor a pressure reading within entry vestibule 136. In one example, the airlock control system may not allow either door 170 or 172 to be opened until a pressure reading within second entry vestibule 136 exceeds a pressure reading within corridor 104 by a predetermined amount. The control system may be configured to unlock facility-side door 172 and provide one or more audio or visual indicators to the person inside the vestibule when the pressure inside the vestibule meets or exceeds the predetermined amount above the pressure in corridor 104. In one example, the airlock control system may also be configured to negatively pressurize second entry vestibule 136 relative to first entry vestibule 134 before unlocking entry-side door 170 and allowing access to second entry vestibule 136 to thereby ensure airflow is from the first entry vestibule to the second entry vestibule. In one example, when the airlock control system negatively pressurizes second entry vestibule 136, the pressure of second entry vestibule 136 is an intermediate pressure between a higher pressure in first entry vestibule 134 and a lower pressure in corridor 104 to ensure airflow is always in a direction from outside 160 into ICU 100.

First exit vestibule 140 may be designed and configured in a similar manner as second entry vestibule 136 and controlled by the airlock control system in a similar manner. For example, first exit vestibule 140 may include a facility-side door 174 and an exit-side door 176. The airlock control system may be configured to not allow both of doors 174, 176 to be opened at the same time to ensure there is no direct path for air to exit to second exit vestibule 142 and outside 160. Also, the airlock control system may be configured to cause the HVAC system to pressurize first exit vestibule 140 to a pressure that exceeds the pressure in corridor 104 by a predetermined amount so that when facility-side door 174 is opened, air flows from first exit vestibule 140 into corridor 104. The control system may unlock facility-side door 174 once first exit vestibule 140 is adequately pressurized and may unlock exit-side door 176 once facility-side door 174 is indicated as secure. In one example, the airlock control system may also be configured to alter the pressure in first exit vestibule 140 to a negative pressure with respect to second exit vestibule 142 once a person has entered the first exit vestibule to ensure air flows from the second exit vestibule to the first exit vestibule. In one example, when the airlock control system negatively pressurizes first exit vestibule 140, the pressure of first exit vestibule 140 is an intermediate pressure between a higher pressure in second exit vestibule 142 and a lower pressure in corridor 104 to ensure airflow is always in a direction from outside 160 into ICU 100.

In another example, in addition to, or instead of an automated airlock control system, manual control of the airlock functions of vestibules 136 and 140 may be provided. Whether automated or manual, electronic and/or analog displays of pressure readings may be located both inside at least second entry vestibule 136 and first exit vestibule 140 and in corridor 104, and may also include visual and/or audible indicators for indicating when the pressure within entry or exit vestibules have reached an appropriate level for entry into or exit from the corridor. In addition to monitoring pressure in entry vestibule 136, exit vestibule 140, and corridor 104, ICU 100 may also include a pressure monitoring system that includes at least one pressure sensor in every space of ICU 100. In one example, at least one display is included in each space to display the current pressure. In another example, the pressure monitoring system may include a central display that displays the pressures of all rooms and may also display pressure set points for each room. The pressure monitoring system may also include visual and audible alarms, including a warning alarm when a pressure in a given room is approaching a maximum allowable deviation from a set point, and an emergency alarm when the pressure exceeds a maximum allowable deviation.

The HVAC system may also be configured to separately control the pressure in soiled workroom 116, contaminated waste room 118, and clean workroom 120. In one example, clean workroom 120 is maintained at a higher pressure than soiled workroom 116 and contaminated waste room 118. As with entry and exit vestibules 134, 136, 140, and 142, the airlock control system may control locking mechanisms associated with doors 177, 178, and 179 to ensure that all three doors are never opened at the same time. In one embodiment, the airlock control system may require at least door 178 separating soiled workroom 116 from contaminated waste room 118 to be closed before door 177 separating the soiled workroom from corridor 104 may be opened. In addition, contaminated waste room 118 may be configured as an airlock, wherein door 178 may not be opened unless door 179 is closed and the pressure in the contaminated waste room is below a predetermined value. After opening door 178 and entering contaminated waste room 118, the airlock control system may unlock door 179 to outside 160 only after door 178 is secure and the pressure in the contaminated waste room is below a predetermined value. Such a control procedure can ensure there is no direct path for contaminated air to flow from ICU 100 to outside 160, and the negative pressure relationship ensures that when door 179 is opened to dispose of the contaminated waste, air will flow into the ICU such that contaminated air will not escape.

ICU 100 may also include decontamination systems for selectively disinfecting and/or sterilizing any of the spaces within ICU 100. The decontamination systems can include any disinfecting or sterilizing means currently in existence or developed at a later date, including automated decontamination systems. In one example, the decontamination systems may include one or more of fogging systems, decontaminant misting and spray systems, and ultraviolet (UV) light, e.g., UV-C light systems for killing pathogens. Any fogging system can be used, for example, chlorine, hydrogen peroxide, and/or ionic silver, etc. fogging systems. As discussed above, the HVAC system may also include UV-C light systems, including pulsed mercury and pulsed xenon systems, among others, fogging systems for exhaust air, and/or incendiary systems. In one example, each of the spaces within ICU 100 may be equipped with automated decontamination systems such that each room can be individually disinfected and/or sterilized between use. In one example, an automated decontamination system may be activated every time after someone passes through a space in ICU 100 prior to allowing another person to enter the same space. In one example a fogging system similar to the hydrogen peroxide system used in the STERIS® VAPROQUIP® Decontamination Room may be utilized. In one example, one fogging system located in corridor 104 may be sized for decontaminating both the corridor and any one of patient rooms 138, 144, 146 that have open doors. In another example separate fogging systems may be located in one or more of the spaces within ICU 100. At least first exit vestibule 140 may also include decontamination shower 180 that can be used for decontaminating a staff member or patient prior to exiting ICU 100. First exit vestibule 140 may also include a decontamination shoe bath, e.g., a bleach or other decontamination solution, for disinfecting and/or sterilizing staff and patient footwear. In some examples, one of entry vestibules 134, 136 may also include a decontamination system similar to exit vestibules 140, 142 so that the entry vestibules can be used for exit in the case of emergency or when the exit vestibules are not operable.

The components and features of ICU 100 may also be designed to make disinfecting and/or sterilization processes easier and more effective, and to minimize the need for patients and staff to touch surfaces in the facility. For example, as noted above, each of patient rooms 138, 144, and 146 may have sliding doors (not illustrated) for gaining access to the patient rooms that can be actuated using a non-touch method such as an elbow or knee panel. The use of handles, control knobs, and any other operating mechanism that requires using a hand is also minimized in ICU 100 and all surfaces may be designed to eliminate crevasses and hidden areas to improve the effectiveness of decontaminating processes. In addition, control of many or all systems within ICU 100 may be located in clean spaces, remote from ICU 100, and/or via an electronic tablet encased in a protective and removable covering that may be operated with a stylus enclosed in a protective and removable sheath. For example, control of thermostats, lighting, entertainment systems, privacy curtain openings, etc. can be controlled as such.

Clean workroom 120 may be used to clean and sterilize items that are not disposable. Soiled workroom 116 may be used for separating items that will be thrown away from items that will be sterilized and reused. In one example, the HVAC system may be configured to positively pressurize clean workroom 102 in relation to corridor 104, soiled workroom 116, and contaminated waste room 118. In one example, items may be cleaned in clean workroom 120 by following any sterilization procedure required by applicable regulations. In one example, items may be encased in a covering, e.g., double-wrapped and taped, e.g., with CSR tape, and then subjected to sterilization in sterilizer 181 in the clean workroom. In one example, items that be sterilized in clean workroom 120 may include small reusable instruments such as bandage scissors, etc. In another embodiment, ICU 100 may not have clean room 120 and all used materials will be disposed of as contaminated waste.

ICU 100 may include a variety of other systems. For example, ICU 100 may include a liquid waste system (not illustrated) that ensures all liquid waste generated within the ICU is contained and properly treated. In one example, a liquid waste system may include one or more holding tanks for receiving and storing liquid waste and decontamination systems for decontaminating the waste. In one example, the decontamination system may inject a disinfectant, e.g., bleach, into the holding tanks. ICU 100 may also include is a full medical gas system (not illustrated) with large storage tanks, manifolds, zone valves, and alarm system and hospital grade outlets. ICU 100 may also include a robust vacuum system throughout the unit which may include extra filters to prevent contaminating the system. Illustrated ICU 100 may also have electrical systems (not illustrated) designed in compliance with applicable electrical standards. In one example, electrical systems may include a separate equipment circuit, a critical circuit, and life safety circuit. The electrical system may also include at least one, and in some examples, two backup systems. In one example, ICU 100 may include a first full power backup system utilizing a hospital grade transfer switch and a second backup system including an Uninterruptible Power Supply (UPS) system to protect all critical electronics as well as provide power during a brief transition to emergency power by the transfer switch. This redundancy ensures the continuation of negative pressure environments within the ICU 100 and the continued operation of all equipment. In embodiments where ICU 100 includes movable walls for transitioning from a transportable configuration to an operating configuration, any one of the systems disclosed herein may incorporate flexible rather than rigid tubing, such as a GORE® Track System.

ICU 100 may also include an advanced telemedicine system (not illustrated) that may include a plurality, e.g., 20, Ethernet ports, a plurality of phone/fax ports, and a plurality of video inputs and outputs to a network server that can be used alone or with a larger network. The system may include data, voice, video, and clock displays that may be integrated. In one example, the telemedicine system may be configured to support video consults, diagnostic grade imaging and any other telemedicine function. In one example, the entire telemedicine system can be upgraded with plug and play technology. An extensive video and telemetric monitoring system can allow for Intensive Care Unit-level monitoring of a patient without full bio hazard suit protection which can allow caregivers in protective attire to focus on delivering direct care to a patient with such functions as examining, starting intravenous therapy, medicating, and meeting the physical and medical needs of a patient while providing an external monitoring function concurrently while not in containment attire. In the case of ICU 100, this monitoring capability may be provided at a remote location outside of the ICU. In other embodiments (described more below), a mobile ICU made in accordance with the present disclosure may include a separate clean area including a nurses station for performing monitoring.

In some embodiments, ICU 100 may also include communication and entertainment systems in one or more of patient rooms 138, 144, and 146 to help support the emotional wellbeing of patients, which can be key to a patient's health. For example, one or more of patient rooms 138, 144, and 146 may include a flat screen monitor that can serve several functions. For example, the monitor may be configured to display a view similar to a window to the outside world, such as a scene familiar to a patient, or an otherwise pleasant scene. The monitor may also be used as a connection for video, text, and sound communications with friends and family, including telephone, video chat or any social media application. The monitor may also be used for communications with healthcare workers providing treatment to a patient. The monitor can also be used for entertainment purposes with videos, live TV or games, for example. Patient rooms 138, 144, and 146 may also include a small refrigerator and the availability of snacks and drinks as allowed by their medical condition. In one example, the patient room monitors may be located in a wall of a respective patient room and may have a sealed covering such as acrylic glass to prevent contamination of the monitor and its internal circuits and spaces within the monitor. In one example, the monitors are located in the walls at the foot of beds 182, 184, 186. In some embodiments, corridor side walls 188, 190, and 192 of patient rooms 138, 144, and 146 may be completely or partially transparent, which can help minimize a patient's feeling of isolation and improve a patient's emotional wellbeing.

Figure 2:
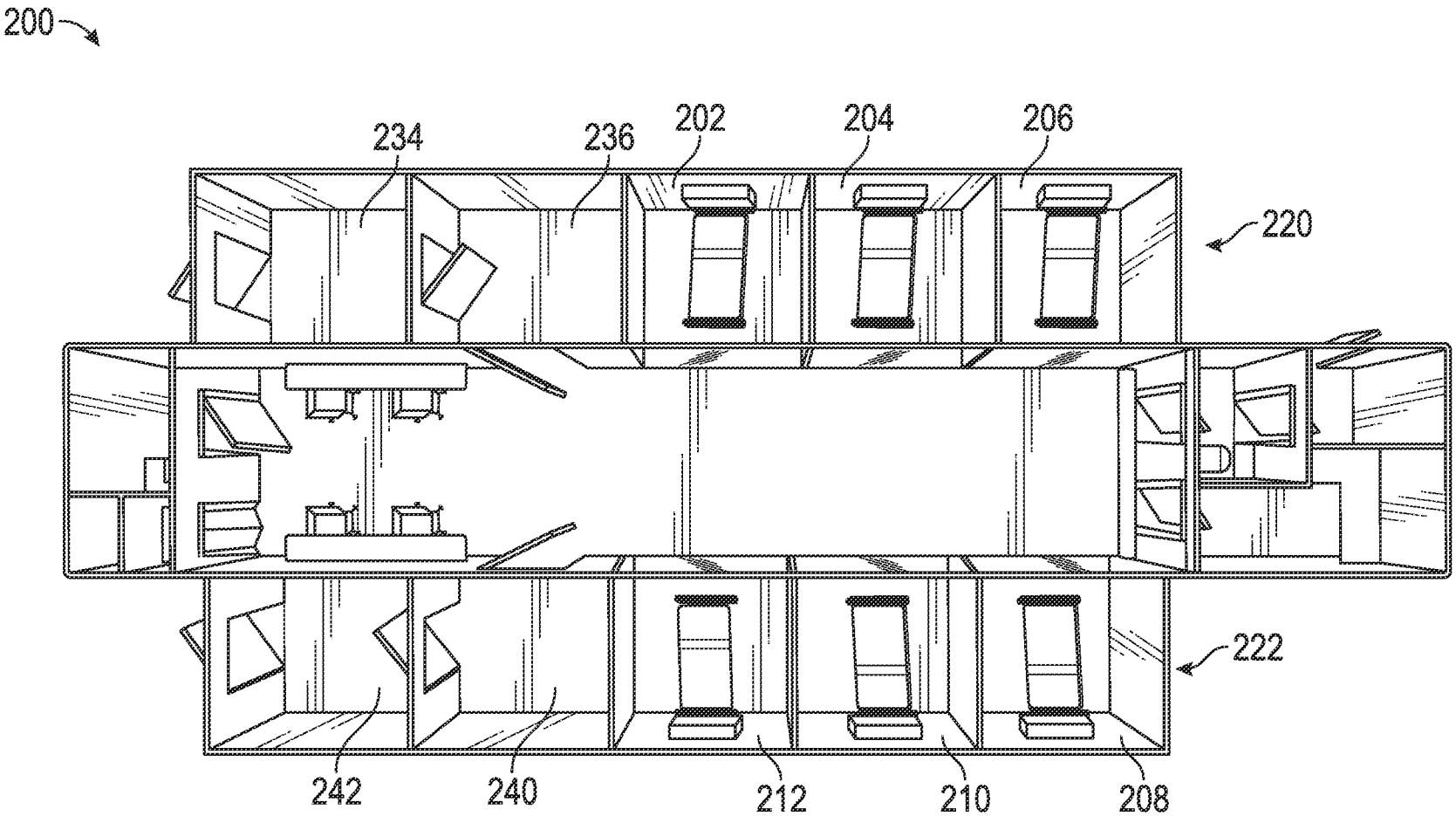
FIG. 2 is a plan view of a second embodiment of a mobile isolation and containment unit.

FIG. 2 shows an alternative ICU 200 having substantially the same design and configuration described above for ICU 100, but with six patient rooms 202, 204, 206, 208, 210, and 212, rather than three. In the illustrated example, three patient rooms, 202-206 are located in first side section and the other patient rooms 208-212 are located in second side section 222. First and second entry vestibules 234, 236 have a reduced size as compared to entry vestibules 134, 136 (FIG. 1) to accommodate the additional patient rooms in first side section 220. As with ICU 100, ICU 200 incorporates a multiple-vestibule design with dual entry vestibules 234, 236 and dual exit vestibules 240, 242 that may have the same airlock functionality and door lock logic control as vestibules 136 and 140 (FIG. 1) discussed above. In addition, ICU 200 may include any of the various systems and subsystems as ICU 100, including HVAC and decontamination systems.

Figure 3:
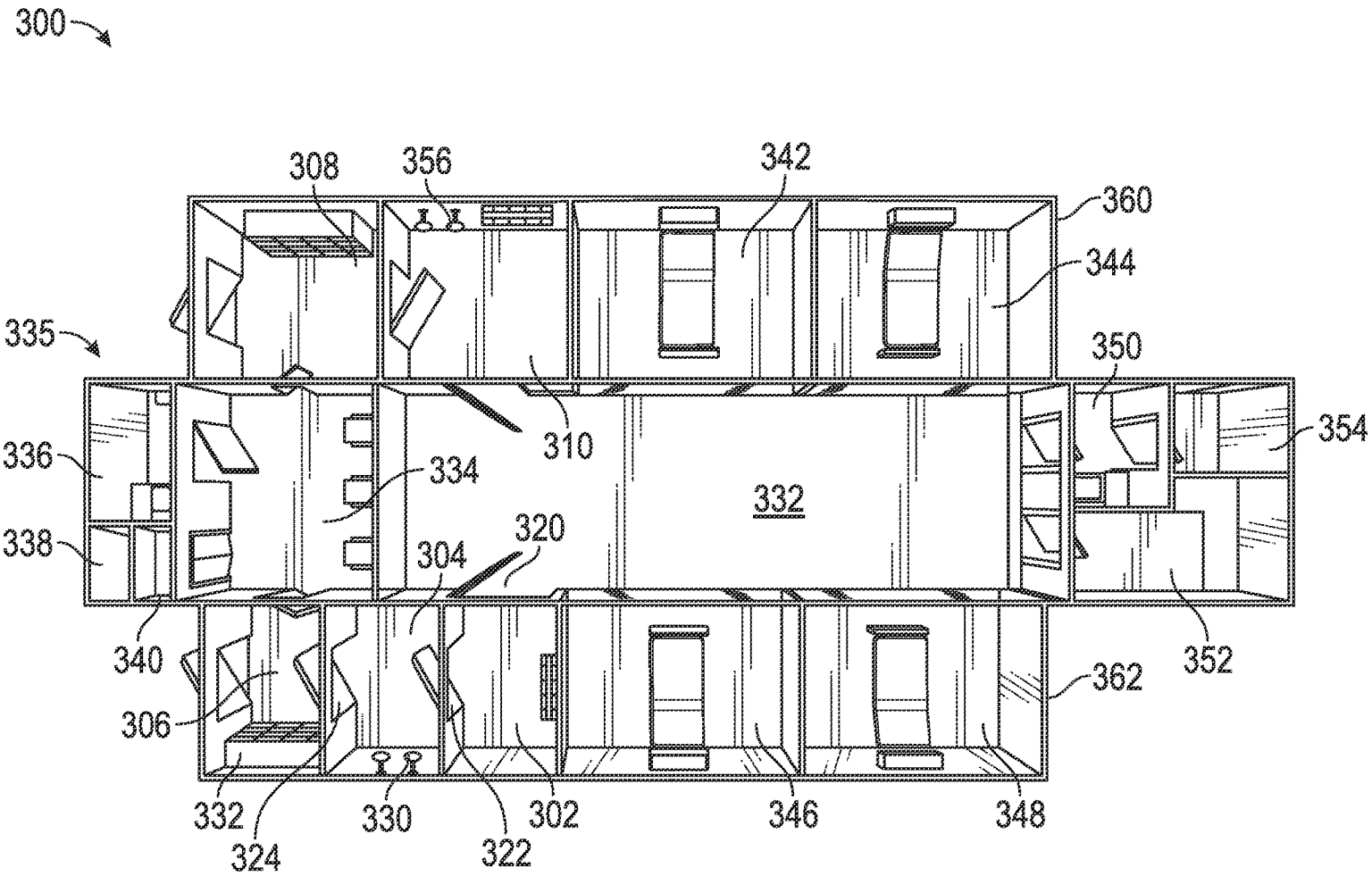
FIG. 3 is a plan view of a third embodiment of a mobile isolation and containment unit.

FIG. 3 illustrates an alternative ICU 300 made in accordance with the present disclosure. ICU 300 may have any of the systems and capabilities of ICU 100 or 200 (FIGS. 1 and 2) and similarly has a multiple vestibule configuration. However, unlike ICUs 100 and 200, ICU 300 has three exit vestibules 302, 304, and 306 instead of two. As with ICUs 100 and 200, ICU 300 has two entry vestibules 308, 310. As with ICUs 100 and 200, second entry vestibule 310 and first exit vestibule 302 may be configured as airlocks and be similarly controlled by an automatic and/or manual airlock control system. In the illustrated example, second exit vestibule 304 may also be configured as an airlock. In one example, the HVAC system for ICU 300 may be configured to independently control the pressure in each of exit vestibules 302, 304, and 306. In one example, after pressurizing first exit vestibule 302, entering the first exit vestibule and closing vestibule door 320, the occupant may remove all clothing and other equipment for either disposal or sterilization, depending on the ability to sterilize. With exit vestibule doors 320, 322, and 324 secure, the HVAC system may pressurize second vestibule 304 to a higher pressure than first exit vestibule 302 and once the pressure differential meets or exceeds a predetermined amount, may unlock exit vestibule door 322 and allow passage from first exit vestibule 302 to second exit vestibule 304. Second exit vestibule 304 may include decontamination shower 330 that an occupant may use for cleaning and disinfecting as necessary to remove any possible trace amounts of pathogens. Once the occupant has been cleaned and disinfected, the occupant may open door 324 and enter third exit vestibule 306 and put on sterile clothing located in clothing storage 332. As described more below, in one embodiment, after a person has exited each of exit vestibules 302, 304, 306, the respective vestibule may be disinfected and/or sterilized with any of the decontamination systems and methods described herein before another person is allowed to enter the respective vestibules.

Also unlike ICUs 100 and 200, ICU 300 may include a clean area 335 that is separate from corridor 332 and the rest of ICU 300 and can only be accessed via first entry vestibule 308 and can only be exited via third exit vestibule 306. Illustrated clean area 335 includes a nurses station 334 where staff can monitor patients via any one of the telemedicine capabilities discussed above without needing to wear biocontainment suits. Clean area 335 may also include a staff restroom 336, medical gas storage 338, and janitor's closest 340. In one example, the HVAC system may be configured to control a pressure in one or more of the rooms within clean area 335 independently of the other spaces in ICU 300 and may be configured to maintain the clean area at a higher pressure than the rest of ICU 300 to ensure no contaminated airflow enters clean area 330. In one example, clean area is maintained at an intermediate pressure that is lower than atmospheric pressure and higher than a pressure the remainder of ICU 300. For example, with reference to the qualitative relative steady state pressures discussed above in connection with ICU 100, in one example, nurses station 334 may be maintained at a relative steady-state pressure of +1. ICU 300 may also include separate patient restrooms (not illustrated) within each of patient rooms 342, 344, 346, and 348. In another embodiment, each of patient rooms 342, 344, 346, and 348 may simply have a bed pan or similar feature for the patient to use. In another example, corridor 332 may be modified to include a common patient restroom for patients in each of patient rooms 342, 344, 346, and 348. In yet another example, a common patient restroom may be located in place of one of patient rooms 342, 344, 346, and 348. In another example, only one patient restroom may be located in each side section 360, 362, and each of the patient rooms may have a dedicated restroom.

Figure 4:
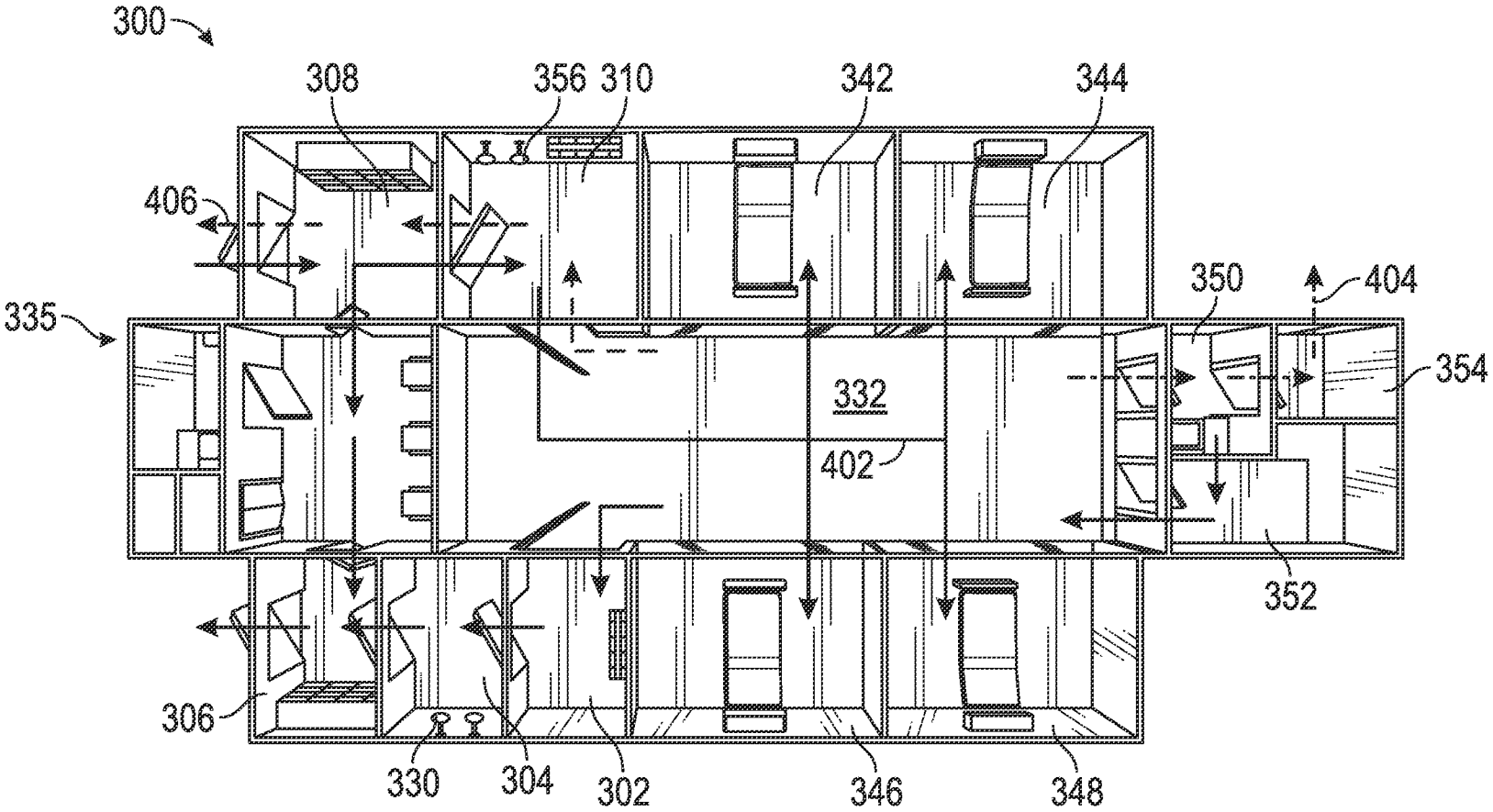
FIG. 4 is a flow diagram illustrating an exemplary flow of staff, patients, supplies, and waste within the mobile isolation and containment unit of FIG. 4.

FIG. 4 is a flow diagram for ICU 300 illustrating standard and reverse flows for controlling the flow of patients, supplies, instruments, contaminated waste and staff into and out of the ICU. Although shown in connection with ICU 300, the same or similar flow control schemes may be implemented for any mobile ICU made in accordance with the present disclosure. In order to minimize risk of cross contamination or a failure in containment of ICU 300, it is important to have a well-developed system of procedures for controlling the flow of patients, supplies, instruments, contaminated waste and staff into and out of the ICU. Standard flow arrows 402 (having a solid line type) illustrate the standard flow of patients, staff, and reusable supplies and instruments. As shown and as described above, the standard flow for entering ICU 300 is through entry vestibules 308, 310, and the standard flow for exiting is through exit vestibules 302, 304, 306. Standard flow for entering and exiting clean area 335 is via entry and exit vestibules 308, 306, as shown. In one example, each time a patient or staff member moves from any room to any other room within ICU 300, the room the patient or staff member was in may be disinfected and/or sterilized with one or more of the decontamination systems and methods described herein before another person enters the space. For example, after a staff member or patient enters ICU 300 through entry vestibules 308 and 310, the entry vestibules may be sterilized before another person can enter the facility. Similarly, any time a patient leaves his or her patient room 342, 344, 346, or 348 and passes through corridor 332, the corridor may be disinfected and/or sterilized before another person may enter the corridor. And after a person exits ICU 300 via exit vestibules 302, 304, 306, each of the exit vestibules may be disinfected and/or sterilized prior to another person entering any of the exit vestibules. Such a decontamination procedure can help avoid cross contamination between people located in the facility despite the close quarters associated with the mobile ICU 300.

The flow of reusable supplies and tools is indicated by the standard flow areas extending from soiled workroom 350 to clean workroom 352 and then to corridor 332. As shown, reusable supplies are initially wrapped, bagged, or otherwise contained according to standard protocols in soiled workroom 350 and are then transported to clean workroom 352 for sterilization in a sterilizer. After sterilization, the reusable supplies and tools may be returned to the ICU for continued use.

Contaminated waste arrows 404 (having a dash-dot-dash line type) illustrate the flow of contaminated waste. In the illustrated example, contaminated waste is first bagged and sealed at the location where the waste is generated and then transported to soiled workroom 350. Once in soiled workroom 350, the waste is bagged and sealed a second time, and then transported to contaminated waste room 354 for storage in, e.g., a sealed contaminated waste container, and subsequent removal. In another example, the waste may be stored in the first and second bags in the contaminated waste room 354 and then transported outside and immediately placed in a third bag that has never been in ICU 300 for final disposal. Having soiled workroom 350 and contaminated waste room 354 as separate rooms from the remainder of ICU 300 may be beneficial for avoiding splashing or contaminating clean equipment or supplies with soiled items. It is also beneficial to have soiled workroom 350 and contaminated waste room 354 located as shown such that contaminated waste can be removed to a safe storage location without transporting the contaminated waste through clean areas of ICU 300.

Reverse flow arrows 406 (having a dash-dash-dash line type) illustrate a reverse flow for patients and staff. As shown, entry vestibules 308 and 310 may be used as exit vestibules in abnormal conditions, e.g., when exit vestibules 302, 304, 306 are not functioning properly or during an emergency when additional exit vestibules are required. In such a scenario, the same exit procedures described above would be executed with entry vestibules 308 and 310, with second entry vestibule 310 being used as an airlock and backup decontamination shower 356 being used as needed in lieu of or in parallel with decontamination shower 330.

Figure 5:
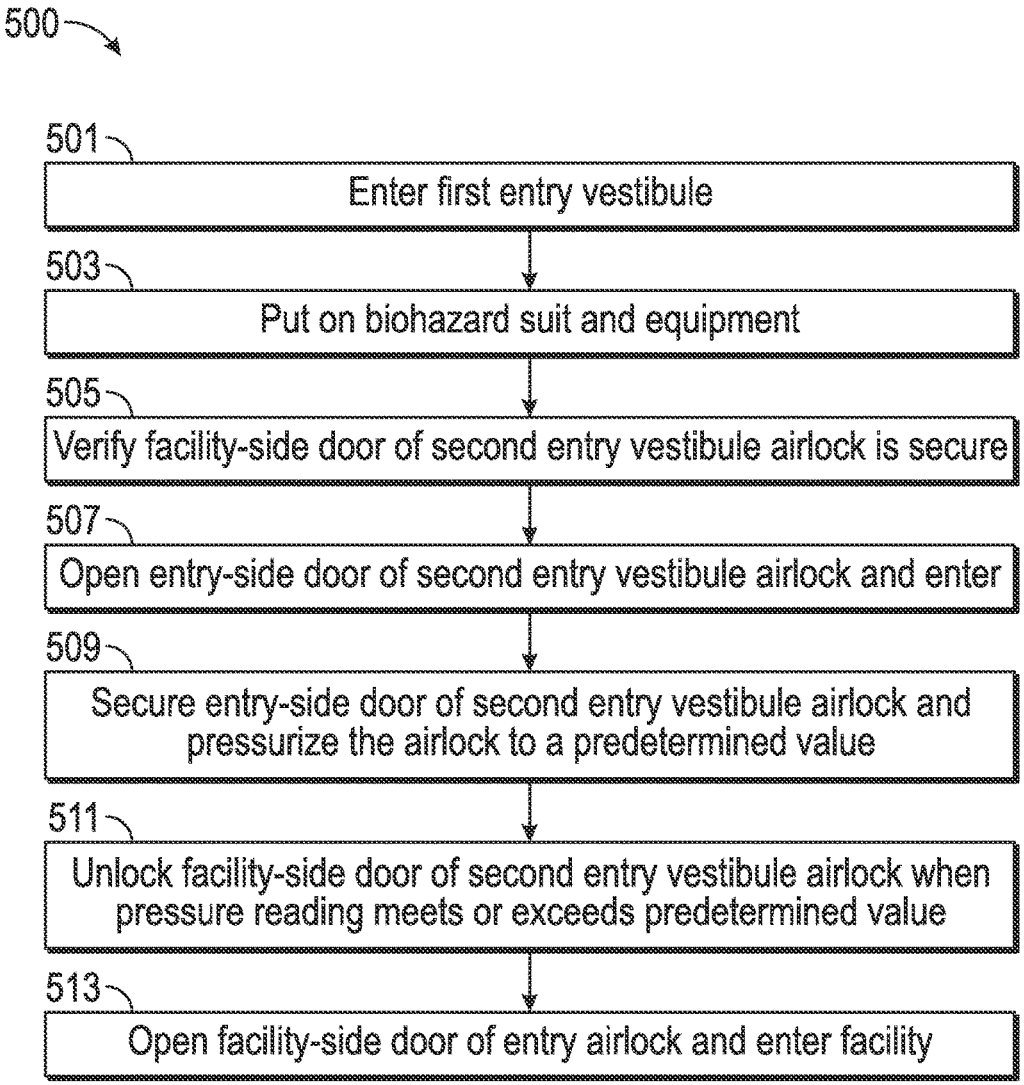
FIG. 5 is a flow chart illustrating an exemplary method for safely entering a mobile isolation and containment unit.

FIG. 5 illustrates an exemplary method of entering a self-contained mobile isolation and containment unit having multiple entry vestibules made in accordance with the present disclosure. As shown, the method may include, at step 501, entering a first entry vestibule. Once inside, at step 503, the occupant may put on a biohazard suit and any other necessary equipment. At step 505, the occupant, or other facility staff, or an automatic airlock control system, may verify a facility-side door of a second entry vestibule airlock is secure. At step 507, after verifying, the occupant may open an entry-side door of the second entry vestibule airlock and enter the second entry vestibule airlock. At step 509, the occupant may secure the entry-side door of the second entry vestibule airlock and the airlock may be pressurized to a predetermined value above a pressure within the ICU. At step 511, after the pressurization is complete, the facility-side door of the second entry vestibule airlock may be unlocked, and at step 513, the facility-side door of the entry airlock may be opened and the occupant may enter the facility. As described above, such a procedure may ensure that airflow is at all times in a direction from outside a facility to within the facility, and may also ensure there is no direct path for airflow or for people through door openings by ensuring any two sequential doors in an entryway path are not open at the same time.

Figure 6:
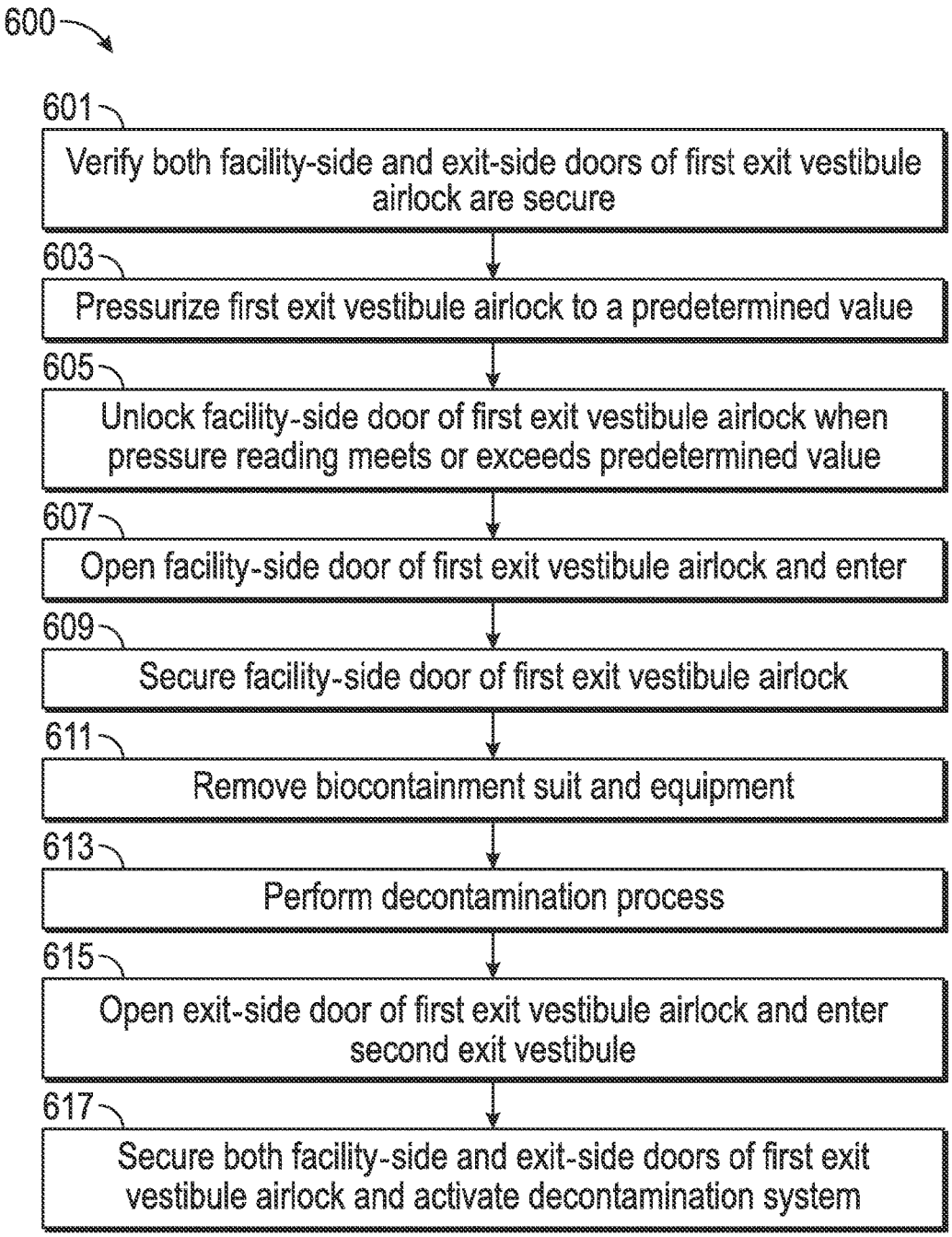
FIG. 6 is a flow chart illustrating an exemplary method for safely exiting a mobile isolation and containment unit.

FIG. 6 illustrates an exemplary method for safely exiting a self-contained mobile isolation and containment unit having multiple exit vestibules made in accordance with the present disclosure. As shown, the method may include, at step 601, verifying both a facility-side and an exit-side door of a first exit vestibule airlock are secure. At step 603, the first exit vestibule airlock may be pressurized to a predetermined value, and at step 605, the facility-side door of the first exit vestibule airlock may be unlocked when the pressure reading meets or exceeds predetermined value. At step 607, the facility-side door of first exit vestibule airlock may be opened and the person may enter. At step 609, the facility-side door of the first exit vestibule airlock may be secured, and at step 611, the occupant may remove his or her biocontainment suit and any associated equipment according to established procedures. At step 613, decontamination and/or wash-down procedures may be performed as needed. In one example, both steps 611 and 613 may be performed in the same exit vestibule. In another example, they may be performed in separate exit vestibules. At step 615, the occupant may open the exit-side door of the first exit vestibule airlock and enter a second exit vestibule, and at step 617, both the facility-side and exit-side doors of first exit vestibule airlock may be secured and a decontamination system can be activated for decontaminating the first exit vestibule. The person may then put on sterilized clothing located in the second or subsequent exit vestibule.

Figure 7:
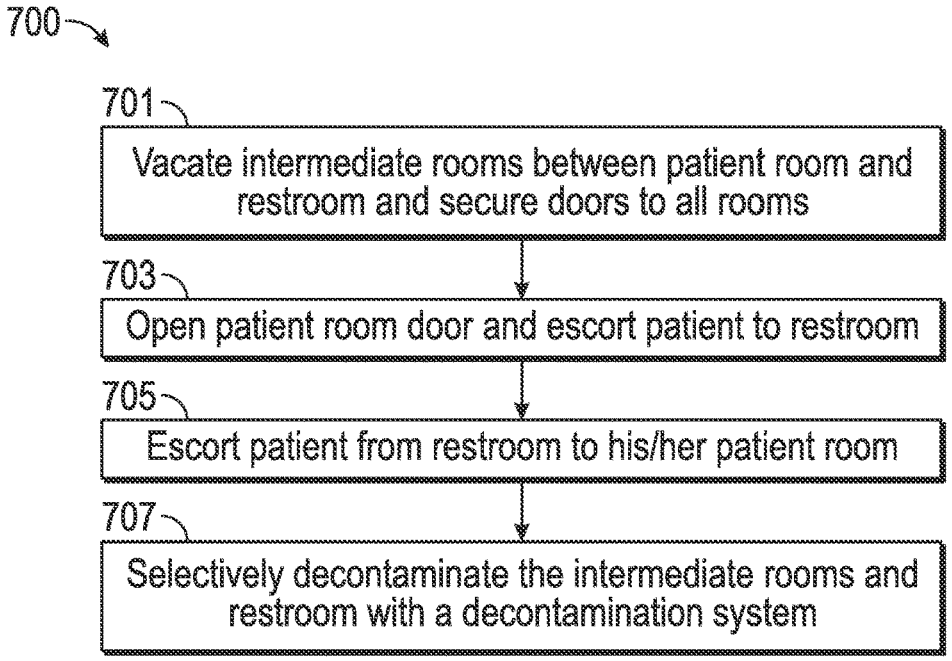
FIG. 7 is a flow chart illustrating an exemplary method for maintaining a sterile environment in a mobile isolation and containment unit with only one restroom and multiple patient rooms.

FIG. 7 illustrates an exemplary method of utilizing a single patient restroom for a plurality of patients infected with contagious diseases that are being isolated in a self-contained mobile isolation and containment unit. As shown, the method may include, at step 701, vacating intermediate rooms between the room of a patient that needs to use the restroom and the restroom and securing all doors to all rooms so that others cannot enter the intermediate rooms. For example, with reference to FIG. 1, step 701 may include vacating corridor 104 and securing all patients within their respective rooms 138, 144, and 146. At step 703, the door of the patient room where the patient that needs to use the restroom is located may be opened and the patient may be escorted or allowed to travel to the restroom. At step 705, after using the restroom, the patient may be escorted or allowed to travel from the restroom to his/her patient room, and at step 707, the intermediate rooms and restroom may be selectively decontaminated with a decontamination system. For example, with reference to FIG. 1, after the patient has used restroom 110 and has returned to his or her room 138, 144, or 146, the restroom and corridor 104 can be decontaminated using one or more of the decontamination systems and techniques disclosed herein, including UV, fogging, and/or spray systems. Such a system and method ensures that patients with varying levels of diseases can share a common area, such as corridor 104 and restroom 110, which may be necessary due to the limited space available in a mobile unit, while ensuring no cross-contamination occurs.

Figure 8:
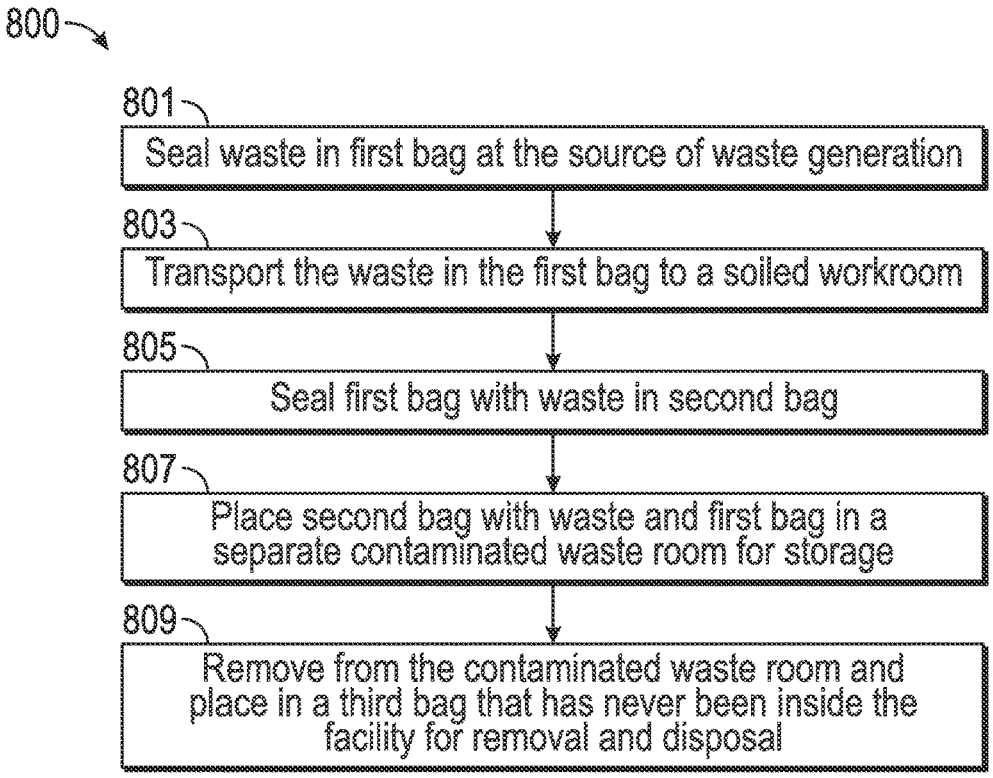
FIG. 8 is a flow chart illustrating an exemplary method for safely disposing of contaminated waste from a mobile isolation and containment unit.

FIG. 8 illustrates an exemplary method of safely disposing of contaminated waste in a self-contained mobile isolation and containment unit made in accordance with the present disclosure. As shown, the method may include, at step 801, sealing contaminated waste in a first bag at the source of waste generation, and at step 803, transporting the waste in the first bag to a soiled workroom within the mobile unit. At step 805, the first bag with waste may be sealed in a second bag, and at step 807, the second bag with waste and first bag may be stored in a separate contaminated waste room for storage. In some examples, the waste may then be sealed in a contaminated waste container located in the contaminated waste room. At step 809, the waste may be removed from the contaminated waste room and placed in a third bag that has never been in the facility and disposed of by established waste disposal procedures, e.g., incineration by an incinerator not located within the mobile facility.

Any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 9:
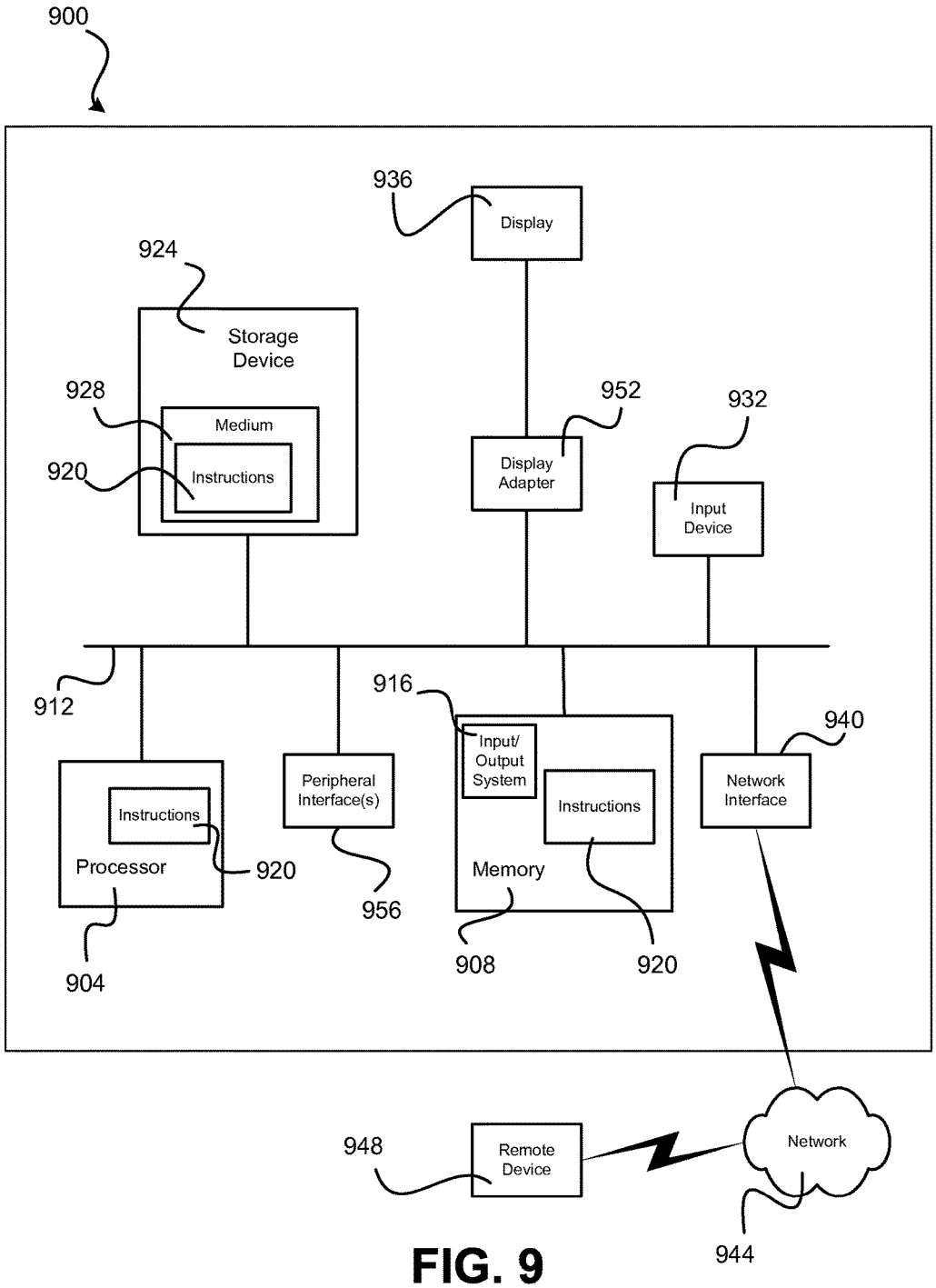
FIG. 9 is a block diagram of a computing system that can be used to implement various aspects of the systems and methods disclosed herein.

FIG. 9 shows a diagrammatic representation of one embodiment of a computing device in the exemplary form of a computer system 900 within which a set of instructions for causing a control system, such as the airlock control systems and/or telemedicine systems described above, to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 900 includes a processor 904 and a memory 908 that communicate with each other, and with other components, via a bus 912. Bus 912 may include any of several types of bus structures including, but not limited to, a memory bus, a memory controller, a peripheral bus, a local bus, and any combinations thereof, using any of a variety of bus architectures.

Memory 908 may include various components (e.g., machine-readable media) including, but not limited to, a random access memory component, a read only component, and any combinations thereof. In one example, a basic input/output system 916 (BIOS), including basic routines that help to transfer information between elements within computer system 900, such as during start-up, may be stored in memory 908. Memory 908 may also include (e.g., stored on one or more machine-readable media) instructions (e.g., software) 920 embodying any one or more of the aspects and/or methodologies of the present disclosure. In another example, memory 908 may further include any number of program modules including, but not limited to, an operating system, one or more application programs, other program modules, program data, and any combinations thereof.

Computer system 900 may also include a storage device 924. Examples of a storage device (e.g., storage device 924) include, but are not limited to, a hard disk drive, a magnetic disk drive, an optical disc drive in combination with an optical medium, a solid-state memory device, and any combinations thereof. Storage device 924 may be connected to bus 912 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 924 (or one or more components thereof) may be removably interfaced with computer system 900 (e.g., via an external port connector (not shown)). Particularly, storage device 924 and an associated machine-readable medium 928 may provide nonvolatile and/or volatile storage of machine-readable instructions, data structures, program modules, and/or other data for computer system 900. In one example, software 920 may reside, completely or partially, within machine-readable medium 928. In another example, software 920 may reside, completely or partially, within processor 904.

Computer system 900 may also include an input device 932. In one example, a user of computer system 900 may enter commands and/or other information into computer system 900 via input device 932. Examples of an input device 932 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 932 may be interfaced to bus 912 via any of a variety of interfaces (not shown) including, but not limited to, a serial interface, a parallel interface, a game port, a USB interface, a FIREWIRE interface, a direct interface to bus 912, and any combinations thereof. Input device 932 may include a touch screen interface that may be a part of or separate from display 936, discussed further below. Input device 932 may be utilized as a user selection device for selecting one or more graphical representations in a graphical interface as described above.

A user may also input commands and/or other information to computer system 900 via storage device 924 (e.g., a removable disk drive, a flash drive, etc.) and/or network interface device 940. A network interface device, such as network interface device 940, may be utilized for connecting computer system 900 to one or more of a variety of networks, such as network 944, and one or more remote devices 948 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 944, may employ a wired and/or a wireless mode of communication. In general, any network topology may be used. Information (e.g., data, software 920, etc.) may be communicated to and/or from computer system 900 via network interface device 940.

Computer system 900 may further include a video display adapter 952 for communicating a displayable image to a display device, such as display device 936. Examples of a display device include, but are not limited to, a liquid crystal display (LCD), a cathode ray tube (CRT), a plasma display, a light emitting diode (LED) display, and any combinations thereof. Display adapter 952 and display device 936 may be utilized in combination with processor 904 to provide graphical representations of aspects of the present disclosure. In addition to a display device, computer system 900 may include one or more other peripheral output devices including, but not limited to, an audio speaker, a printer, and any combinations thereof. Such peripheral output devices may be connected to bus 912 via a peripheral interface 956. Examples of a peripheral interface include, but are not limited to, a serial port, a USB connection, a FIREWIRE connection, a parallel connection, and any combinations thereof.

The foregoing has been a detailed description of illustrative embodiments of the disclosure. Various modifications and additions can be made without departing from the spirit and scope of this disclosure. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve the methods and systems according to the present disclosure. Accordingly, this description is meant to be taken only by way of example, and not to otherwise limit the scope of this disclosure.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A mobile isolation unit, comprising:

a first and a second vestibule;

a common area; and at least one patient room, wherein entry to the at least one patient room requires passage through the common area and entry to the common area from a location outside the mobile isolation unit or exit from the common area to a location outside the mobile isolation unit requires passage through both of the first and second vestibules, wherein one of the first and second vestibules is adjacent the common area and is configured as an airlock to prevent the flow of contaminated air from the mobile isolation unit.

2. A mobile isolation unit according to claim 1, further comprising a heating, ventilation, and air-conditioning (HVAC) system designed and configured to separately and independently control an air pressure in each of the second vestibule, the common area, and the at least one patient room.

3. A mobile isolation unit according to claim 2, wherein the second vestibule includes a first door separating the second vestibule from the common area and a second door separating the second vestibule from the first vestibule, the mobile isolation unit further comprising an airlock control system configured to secure the first and second doors and instruct the HVAC system to positively pressurize the second vestibule before the first door can be opened.

4. A mobile isolation unit according to claim 1, further comprising third and fourth vestibules, wherein entry to the common area from a location outside the mobile isolation unit requires passage through both of the first and second vestibules and exit from the common area to a location outside the mobile isolation unit requires passage through both of the third and fourth vestibules.

5. A mobile isolation unit according to claim 4, wherein the second and third vestibules are adjacent the common area and are configured as airlocks to prevent the flow of contaminated air from the mobile isolation unit.

6. A mobile isolation unit according to claim 5, further comprising a fifth vestibule adjacent the fourth vestibule, the third vestibule being configured for removal of a biocontainment suit by an occupant located in the third vestibule, the fourth vestibule including a decontaminating spray system for decontaminating the occupant when located in the fourth vestibule, and the fifth vestibule including sterile clothing storage for providing sterile clothing to the occupant when located in the fifth vestibule prior to exiting from the mobile isolation unit.

7. A mobile isolation unit according to claim 5, wherein the at least one patient room includes a plurality of patient rooms directly accessible from the common area, wherein a supply air for each of the plurality of patient rooms is directly obtained from an outside environment outside of the mobile isolation unit and exhaust air from each of the plurality of patient rooms is directly exhausted to the outside environment.

8. A mobile isolation unit according to claim 7, wherein each of the plurality of patient rooms are designed and configured to contain a single patient infected with an infectious disease for an extended period of time.

9. A mobile isolation unit according to claim 1, further comprising an automatic decontamination system for remotely and selectively decontaminating any of the first and second vestibules, common area, and at least one patient room.

10. A mobile isolation unit according to claim 9, wherein the decontamination system includes at least one of a fogging system, an ultraviolet light system, or a decontaminating spray system in each of the first and second vestibules, common area, and at least one patient room.

11. A mobile isolation unit according to claim 9, wherein the at least one patient room comprises at least two patient rooms, the entire unit further comprising only one patient restroom, the decontamination system being configured to selectively decontaminate the restroom and the common area after each time a patient uses the patient restroom.

12. The isolation unit of claim 1, further comprising a display screen in the at least one patient room for improving patient emotional well-being by providing at least one of a display of a view of the outdoors or other image that is adapted to make a patient feel more comfortable, communication with friends and family, display video, or play music.

13. A method of controlling a mobile isolation unit having a common area, a common patient restroom, at least two patient rooms accessible from the common area, and a remotely activated decontamination system for selectively decontaminating areas within the mobile isolation unit, the method comprising:

vacating the common area and the patient restroom;

allowing a patient infected with an infectious disease to travel from one of the patient rooms, through the common area to the patient restroom and to then return to the one of the patient rooms;

remotely activating the decontamination system to decontaminate the common area and the patient restroom before anyone else is allowed in either the common area or the patient restroom.

14. A method according to claim 13, the mobile isolation unit further including at least two vestibules and a heating, ventilation, and air-conditioning (HVAC) system, a first one of the at least two vestibules being located adjacent the common area and having a first door and a second door, the method further comprising:

securing the first and second doors;

instructing the HVAC system to pressurize the first one of the at least two vestibules to a pressure that exceeds a pressure in the common area by a first amount;

monitoring the pressure in the first one of the at least two vestibules and the common area; and unlocking only one of the first and second doors when the pressure in the first one of the at least two vestibules exceeds the pressure in the common area by the first amount.

15. A method according to claim 14, wherein the first one of the at least two vestibules is an entry vestibule, further wherein the securing, instructing, monitoring, and unlocking steps are performed each time a person enters the mobile isolation unit.

16. A method according to claim 15, the method further comprising:

remotely activating the decontamination system to decontaminate the entry vestibule after an occupant has moved from the entry vestibule to the common area to thereby decontaminate the entry vestibule.

17. A method according to claim 14, wherein the first one of the at least two vestibules is an exit vestibule, the method further comprising:

prior to the securing step, receiving a request to exit the mobile isolation unit;

wherein the securing, instructing, monitoring, and unlocking steps are performed each time a person exits the mobile isolation unit.

18. A method according to claim 17, wherein the exit vestibule is a first exit vestibule and the at least two vestibules further includes a second exit vestibule, the method further comprising remotely activating the decontamination system to decontaminate the first exit vestibule after an occupant has moved from the first exit vestibule to the second exit vestibule to thereby decontaminate the first exit vestibule.

19. A method according to claim 18, further comprising:

securing the first and second doors of the first exit vestibule after a person has entered the first exit vestibule from the common area;

instructing the HVAC system to decrease the pressure in the first exit vestibule to a pressure below a pressure in the second exit vestibule;

unlocking the one of the first and second doors of the first exit vestibule separating the first and second exit vestibules when the pressure in the first exit vestibule drops below the pressure in the second exit vestibule.

20. A method according to claim 19, further comprising providing a decontaminant via the decontamination system to the occupant after the occupant has entered the second exit vestibule.

* * * * *